US010612748B2

(12) United States Patent
Gandini

(10) Patent No.: US 10,612,748 B2
(45) Date of Patent: Apr. 7, 2020

(54) ARCH-SHAPED LED LAMPS

(75) Inventor: Piero Gandini, Bovezzo (IT)

(73) Assignee: FLOS S.p.A., Bovezzo (IT)

( * ) Notice: Subject to any disclaimer, the term of this patent is extended or adjusted under 35 U.S.C. 154(b) by 26 days.

(21) Appl. No.: 14/002,367

(22) PCT Filed: Feb. 14, 2012

(86) PCT No.: PCT/IB2012/050652
§ 371 (c)(1),
(2), (4) Date: Aug. 30, 2013

(87) PCT Pub. No.: WO2012/140524
PCT Pub. Date: Oct. 18, 2012

(65) Prior Publication Data

US 2014/0022796 A1 Jan. 23, 2014

(30) Foreign Application Priority Data

Apr. 12, 2011 (IT) ..... BS2011A0053

(51) Int. Cl.

| | |
|---|---|
| ***F21V 3/00*** | (2015.01) |
| ***F21V 3/02*** | (2006.01) |
| ***F21V 29/506*** | (2015.01) |
| ***F21V 19/00*** | (2006.01) |
| ***F21V 29/83*** | (2015.01) |
| ***F21S 6/00*** | (2006.01) |
| ***F21V 29/70*** | (2015.01) |
| ***F21V 23/00*** | (2015.01) |
| *F21Y 115/10* | (2016.01) |

(52) U.S. Cl.
CPC ..... *F21V 3/02* (2013.01); *F21S 6/006* (2013.01); *F21V 3/00* (2013.01); *F21V 19/0025* (2013.01); *F21V 23/006* (2013.01); *F21V 29/506* (2015.01); *F21V 29/70* (2015.01); *F21V 29/83* (2015.01); *F21Y 2115/10* (2016.08)

(58) Field of Classification Search
CPC ..... F21S 6/006; F21V 23/003; F21V 23/004; F21V 3/02; F21V 29/506; F21V 29/2268; F21Y 2101/00
USPC ..... 362/235, 317, 355, 427, 361, 360
See application file for complete search history.

(56) References Cited

U.S. PATENT DOCUMENTS

| | | | | |
|---|---|---|---|---|
| 2,840,689 | A * | 6/1958 | Kazor | A47G 33/08 362/35 |
| 8,723,086 | B2 * | 5/2014 | McMahan | H05B 3/0076 219/533 |
| 8,864,348 | B2 * | 10/2014 | Chen | F21V 29/2287 313/46 |
| 2005/0030753 | A1 | 2/2005 | Tickner et al. | |

(Continued)

FOREIGN PATENT DOCUMENTS

DE 102009007794 A1 8/2010

*Primary Examiner* — Karabi Guharay
*Assistant Examiner* — Jessica M Apenteng
(74) *Attorney, Agent, or Firm* — Thomas|Horstemeyer, LLP

(57) ABSTRACT

Floor lamps with arch-shaped support rod are provided. Such floor lamps include a cap and a dome-shaped wall projecting from the top of the cap which is provided with a plurality of through-holes. An LED optical group provides a dissipation plate in contact with the dome-shaped wall. The plate has a plurality of holes or open curvilinear recesses along the peripheral edge, arranged substantially to conceal from the observer the dissipation wall.

12 Claims, 4 Drawing Sheets

(56) References Cited

U.S. PATENT DOCUMENTS

| | | | | |
|---|---|---|---|---|
| 2006/0133098 | A1 | 6/2006 | Lin | |
| 2008/0265736 | A1 | 10/2008 | Chen | |
| 2011/0193463 | A1* | 8/2011 | Daniel | F21V 29/004 313/46 |
| 2012/0025687 | A1* | 2/2012 | Wen | F21V 29/75 313/46 |
| 2013/0188353 | A1* | 7/2013 | Nankil | F21V 21/14 362/235 |

* cited by examiner

ARCH-SHAPED LED LAMPS

CROSS-REFERENCE TO RELATED APPLICATIONS

This application is a National Phase Application of PCT International Application No. PCT/IB2012/050652, International Filing Date, Feb. 14, 2012, claiming priority to Italian Patent Application No. BS2011A000053, filed Apr. 12, 2011, each of which is hereby incorporated by reference in its entirety.

FIELD OF THE INVENTION

The present invention relates to a decorative LED lighting device.

BACKGROUND OF THE INVENTION

The decorative lighting sector is characterised by great efforts to innovate, both from an aesthetic point of view, with the constant search for new forms, and from a technical and functional point of view, often supporting such new aesthetic trends.

Sometimes, technical innovations are needed to make products which are aesthetically valid so as to conceal some of the functional components which if visible, would detract from the aesthetics of the product

SUMMARY OF THE INVENTION

The purpose of the present invention is to make an LED lighting device with bell fitted with apertures, wherein the functional components of the LED optical group are hardly visible to the observer.

Such purpose is achieved by lighting devices comprising a base, a support rod projecting from the base, comprising an arched section, a diffuser group supported by the rod, comprising a cap, having an upper aperture, and a dome-shaped wall projecting from the aperture and provided with a plurality of through-holes, an optical group comprising an LED light source, a dissipator group, to which the source is connected, positioned inside the dome-shaped wall 18, wherein the optical group comprises a dissipation plate positioned at least partially in contact with the dome-shaped wall, having a plurality of holes or lugs along the peripheral edge, to reproduce the edges of the holes of the dome-shaped wall, to conceal from the observer the dissipation wall.

DETAILED DESCRIPTION

Figure 1:
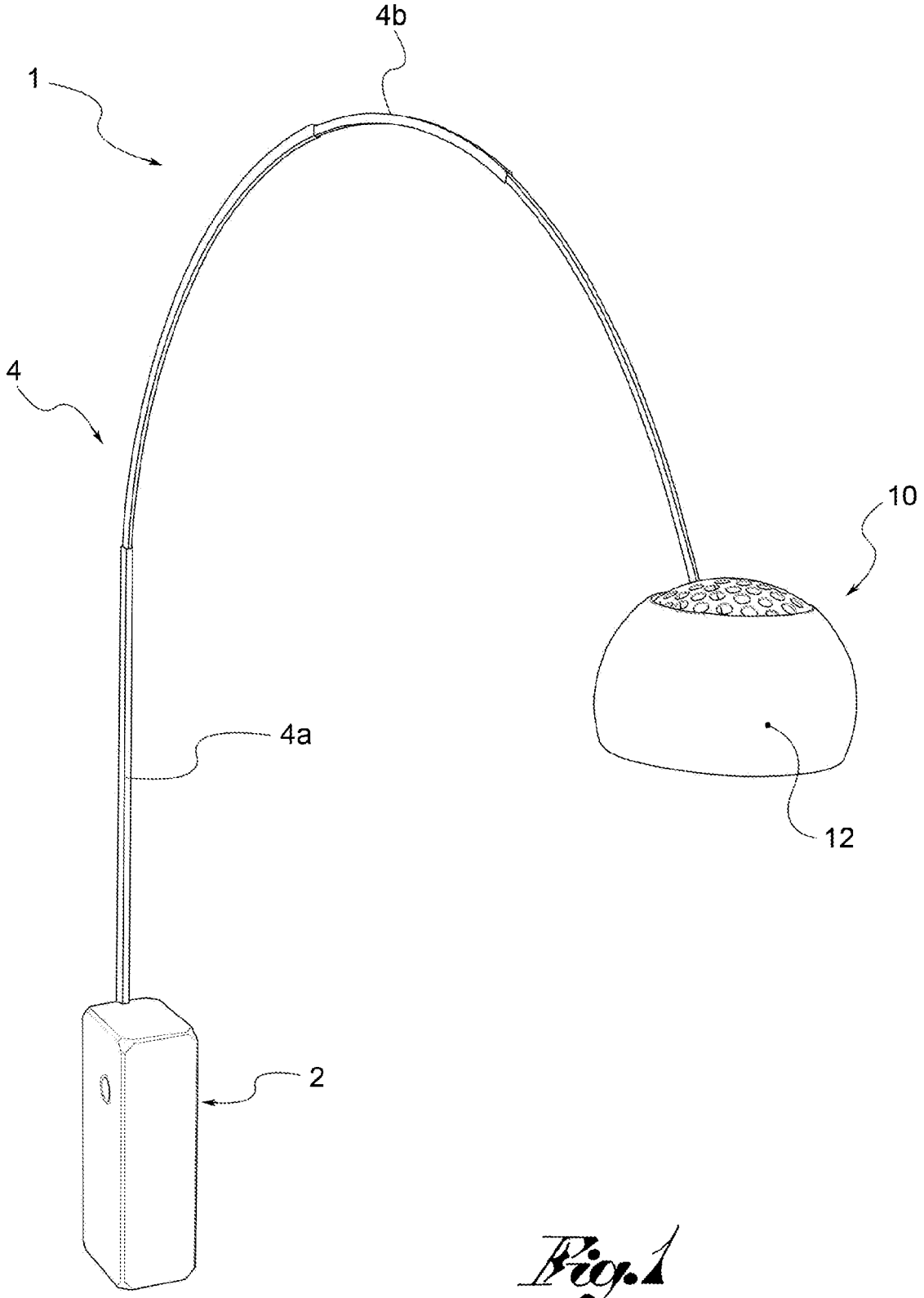
FIG. 1 shows a lighting device according to the present invention.
Figure 2:
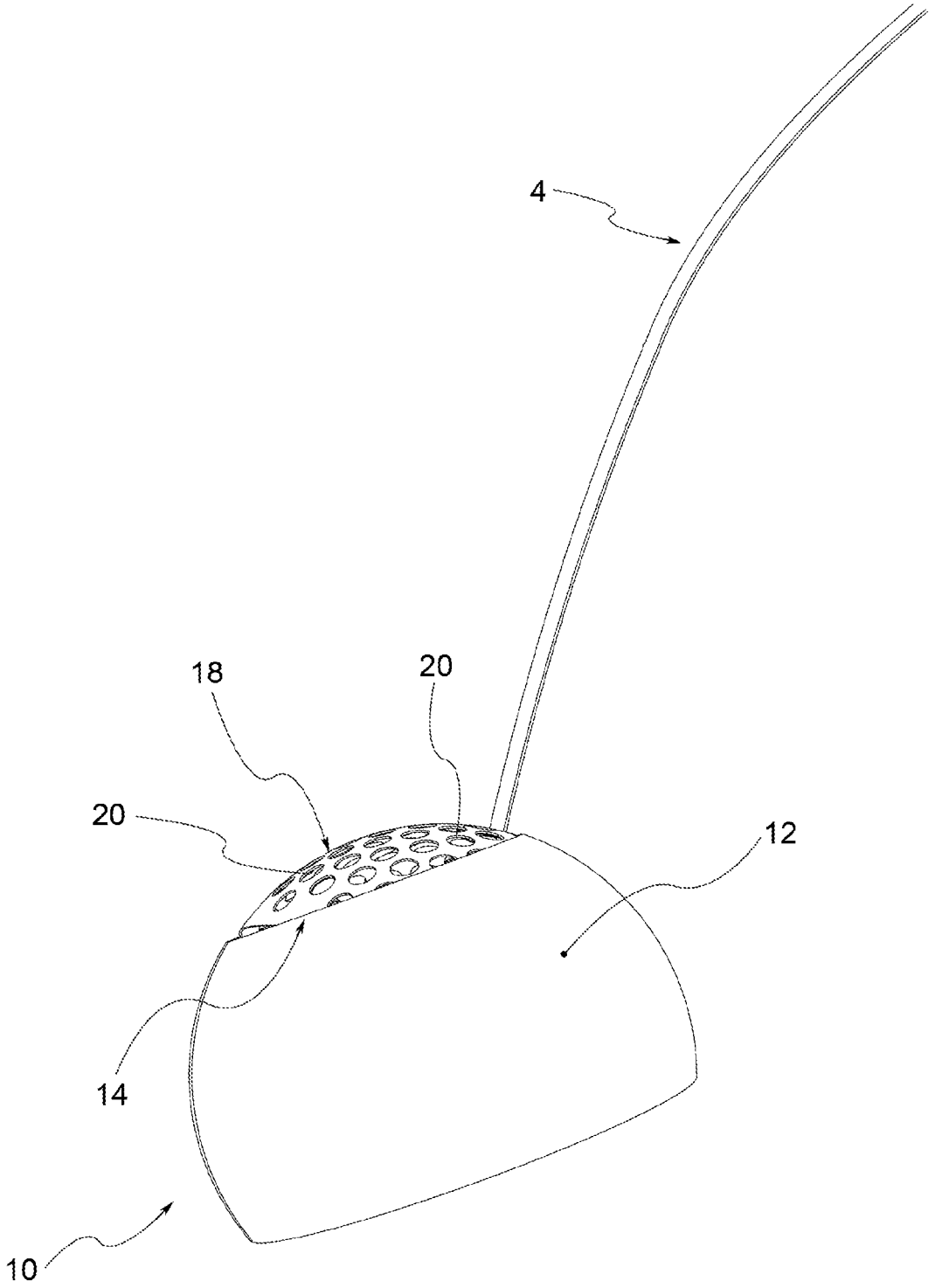
FIG. 2 shows a detail of the diffuser group of the lighting device in FIG. 1.
Figure 3:
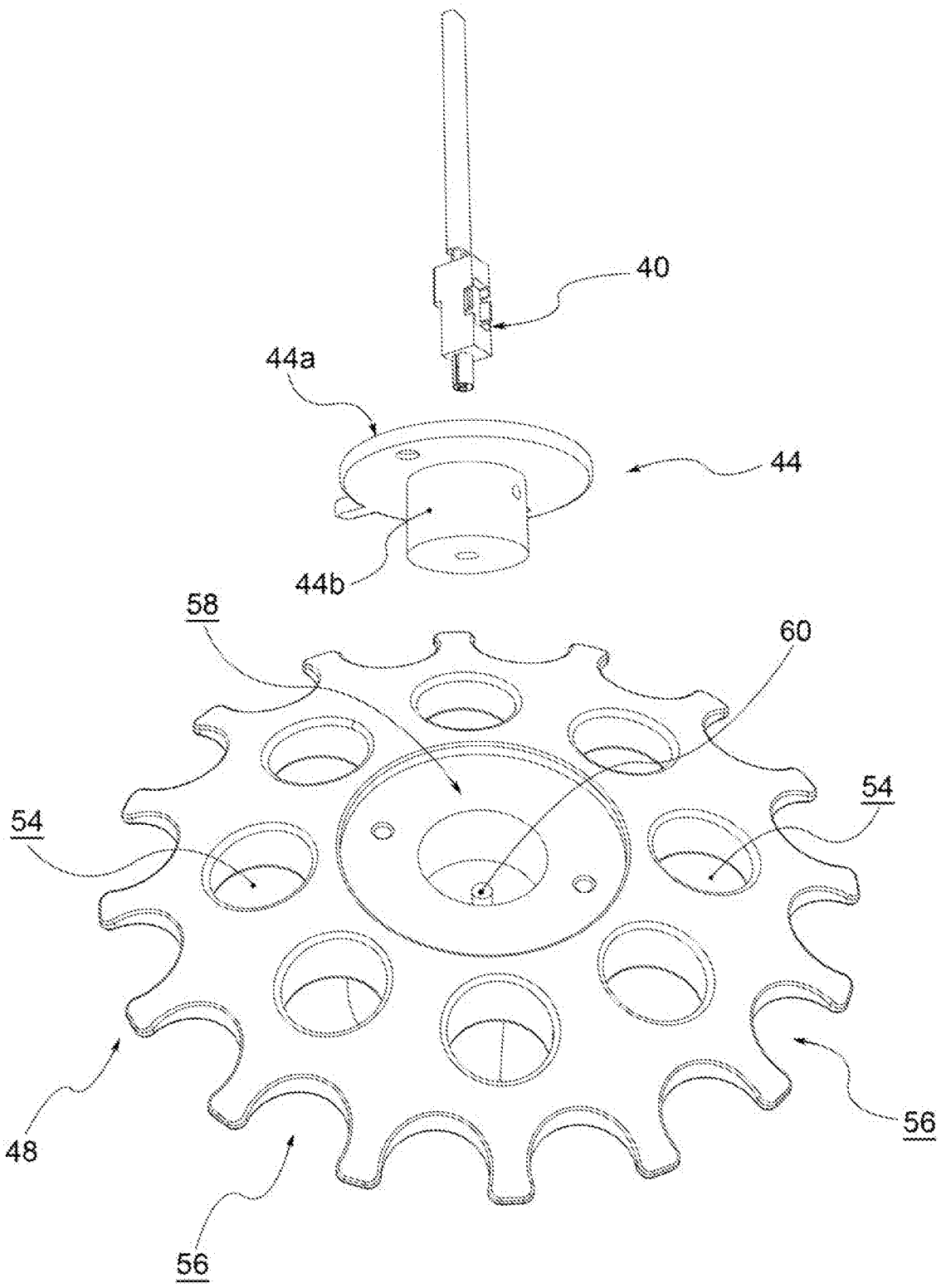
FIGS. 3 and 4 show assembly diagrams of some components of the diffuser group in FIG. 2.
Figure 4:
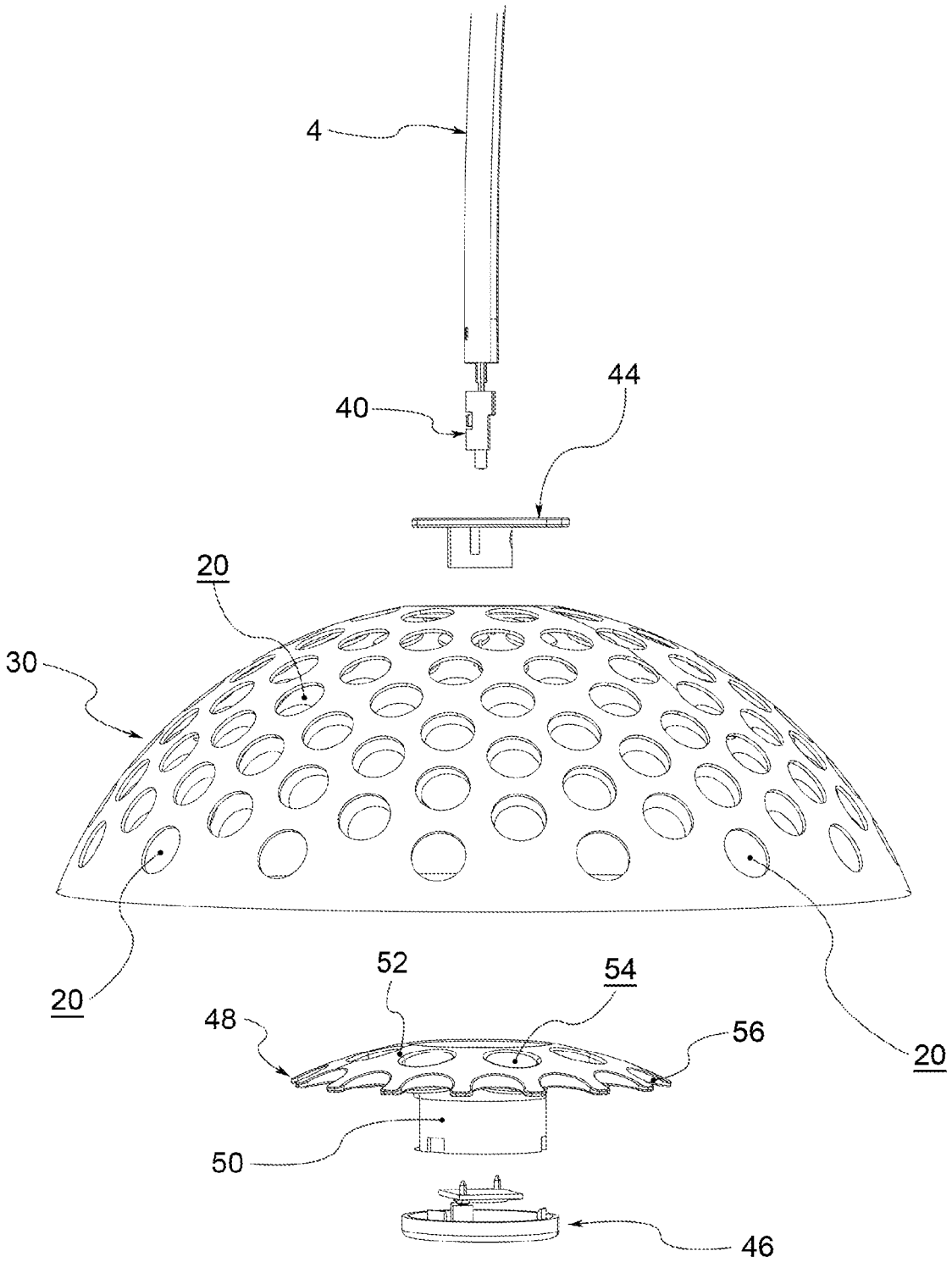

With reference to the appended drawings, reference numeral 1 indicates a floor lighting device.

The device 1 comprises a base 2, preferably made by marble, having for example a parallelepiped shape.

Moreover, the device 1 comprises a support rod 4, projecting from the base 2, comprising a first substantially vertical section 4*a* and a second arched section 4*b*.

In addition, the lighting device comprises a diffuser group 10, supported by the rod 4.

The diffuser group 10 comprises a cap 12 in the shape of a spherical segment, open above by means of an upper aperture 14.

Preferably, the cap is opaque.

Preferably, a dome-shaped wall 18 provided with a plurality of through holes comes out of the aperture 14.

Preferably, the diffuser group 10 comprises a bell 30, which the cap 12 is fitted onto, in a mobile manner. Part of the bell 30 forms the dome-shaped wall 18 which comes out of the aperture 14 of the cap.

The device 1 further comprises an optical group for the electrical connection and support of the light source.

Preferably, the optical group comprises a connector 40, such as a cabling jack, positioned at the terminal end of the rod 4, from which an electric cable concealed inside it, comes out.

In addition, the optical group comprises a plug 44 suitable for engaging with the bell 30, crossing it, and suitable for the insertion of the connector 40.

For example, the plug 44 comprises an abutment base 44*a*, abutting with the outer surface of the bell 30, and an insert 44*b* which projects from the base 44*a*, which crosses the bell 30.

In addition, the optical group comprises an LED light source 46 and a dissipator group 48, suitable for engaging with the bell 30, inside it, on the side opposite the plug 44.

The dissipator group 48 comprises a driver 50 for piloting the LEDs, connectable to the connector 40 which crosses the bell 30, and a dissipation plate 52, destined to come into contact with the bell 30.

Preferably, the plate 52 is concave, similarly to the bell 30, to adhere to its inner surface.

In addition, the plate 52 is fitted with holes 54 or, along the peripheral edge, of open curvilinear recesses 56 to correspond with the holes 20 of the bell, so that to an observer the presence of the plate 52 is practically concealed.

In addition, the plate 52 has a seat 58 centrally for the insertion of the insert 44*b* of the plug 44, and a pin 60 projecting into it, which crosses the bottom of the insert 44*b* and engages the connector 40.

Preferably, the bell 30 and the plate 52 are made by metal, for example by steel.

Preferably moreover the cap 12 is made by metal, for example by steel.

Innovatively, the lighting device described above makes it possible to have LED lighting and at the same time to conceal various functional elements which could detract from the aesthetic appearance of the device.

The invention claimed is:

1. A lighting device comprising:

a base;

a support rod projecting from the base, comprising an arched section;

a diffuser group supported by the rod, comprising a cap, the cap having an upper aperture, and a dome-shaped wall positioned within the upper aperture of the cap and projecting upwardly from the aperture which dome-shaped wall is provided with a plurality of through holes; and an optical group comprising an LED light source including at least one LED, a dissipator group, to which the LED light source is connected, positioned inside the dome-shaped wall;

wherein the optical group comprises a dissipation plate which comprises a plurality of holes or open curvilinear recesses along its peripheral edge shaped to match the shape of the through holes, so that the dissipation plate is concealed from the observer;

and wherein the dissipation plate is placed internally to the dome-shaped wall to adhere to an inner surface of the dome-shaped wall.

2. The device of claim 1, wherein the optical group comprises a driver for piloting the at least one LED, coupled to the dissipation plate and connected to the LED light source.

3. The device of claim 2, comprising a connector positioned at an end of the rod and electrically powered, the support rod configured to pass through the dome-shaped wall and connected to the driver group.

4. The device of claim 1, comprising a bell onto which the cap fits in a mobile manner, wherein a portion of the bell forms the dome-shaped wall.

5. The device of claim 4, wherein the optical group comprises a driver for piloting the LEDs, coupled to the dissipation plate and connected to the LED light source.

6. The device of claim 5, comprising a connector positioned at the end of the rod and electrically powered, the support rod configured to pass through the dome-shaped wall and connected to the driver group.

7. The device of claim 1, wherein the dissipation plate is concave so as to adhere to the inner surface of the dome-shaped wall.

8. The device of claim 7, wherein the optical group comprises a driver for piloting the at least one LED, coupled to the dissipation plate and connected to the LED light source.

9. The device of claim 8, comprising a connector positioned at the end of the rod and electrically powered, the support rod configured to pass through the dome-shaped wall and connected to the driver group.

10. The device of claim 7, comprising a bell onto which the cap fits in a mobile manner, wherein a portion of the bell forms the dome-shaped wall.

11. The device of claim 10, wherein the optical group comprises a driver for piloting the at least one LED, coupled to the dissipation plate and connected to the LED light source.

12. The device of claim 11, comprising a connector positioned at the end of the rod which is electrically powered, the support rod configured to pass through the dome-shaped connect and connected to the driver group.

* * * * *